United States Patent [19]

Taylor et al.

[11] Patent Number: 4,704,045

[45] Date of Patent: Nov. 3, 1987

[54] APPARATUS AND METHOD FOR PULVERIZING ASPHALT

[76] Inventors: Thomas M. Taylor, 9479 W. 89th Cir., Westminster, Colo. 80020; Alfred W. Taylor, 11785 W. 80th Ave., Arvada, Colo. 80005

[21] Appl. No.: 881,805

[22] Filed: Jul. 3, 1986

Related U.S. Application Data

[63] Continuation-in-part of Ser. No. 659,827, Oct. 11, 1985, abandoned.

[51] Int. Cl.[4] ..... E01C 23/12

[52] U.S. Cl. ..... 404/90; 404/92; 404/132; 299/37; 299/39; 172/112; 172/122; 172/125

[58] Field of Search ..... 404/75, 83, 90–92, 404/122, 132; 172/112, 122, 123, 125, 810; 299/36, 39, 37, 40

[56] References Cited

U.S. PATENT DOCUMENTS

| | | | |
|---|---|---|---|
| 3,375,764 | 4/1968 | Petersen | 404/90 |
| 3,901,325 | 8/1975 | Richards | 172/112 X |
| 4,172,679 | 10/1979 | Wirtgen | 404/90 |
| 4,186,968 | 2/1980 | Barton | 404/90 X |
| 4,221,434 | 9/1980 | Swisher, Jr. et al. | 404/90 X |

FOREIGN PATENT DOCUMENTS

| | | | |
|---|---|---|---|
| 1255643 | 12/1971 | United Kingdom | 404/90 |
| 1377359 | 12/1974 | United Kingdom | 404/83 |

*Primary Examiner*—Stephen J. Novosad
*Assistant Examiner*—John F. Letchford
*Attorney, Agent, or Firm*—Bill D. McCarthy

[57] ABSTRACT

An apparatus and method for pulverizing asphalt on roadways and similar applications. The asphalt is pulverized by a rotating drum with removable cutting tips which engage a soften underside of the roadway prior to engaging a harder more compact top surface of the roadway. The apparatus designed for receiving and rotating various widths of drums and adaptable for moving the drum along the width of a mobile piece of equipment supporting the apparatus and adjacent a curb and gutter of a roadway.

8 Claims, 8 Drawing Figures

APPARATUS AND METHOD FOR PULVERIZING ASPHALT

BACKGROUND OF THE INVENTION

This application is a continuation-in-part of the subject inventors's application having Ser. No. 659,827 filed October 11, 1985, now abandoned, and having the same title.

The invention relates to a method and apparatus for pulverizing various types of roadways and ground surfaces and more particularly but not by way of limitation to an apparatus for pulverizing an asphalt roadway.

Heretofore, most ditch and pavement contractors, during street and ditch construction stripped away the asphalt roadway surface and hauled away the pavement by truck. This method is time consuming and expensive. Also it requires the hauling in of new base material along with applying a new paving surface.

There have been various types of asphalt pulverizers, road surface distintegrators, road material mixing machines and the like. These various types of equipment are described in the following U.S. Pat. Nos. 2,905,456 to Rafferty et al, 3,598,027 to Swisher, Jr., 4,129,398 to Schoelkopf, 4,317,642 to Wirtgen, 3,732,023 Rank et al, 2,211,263 to Flynn, 2,397,782 to Flynn, 2,751,205 to Petersen, 4,211,434 to Swisher, Jr., et al, 3,375,764 to Peterson, 4,172,679 to Wirtgen, 4,186,968 to Barton, British Pat. Nos. 1,255,643 to Lockwood and 1,377,359 to Eckey et al. None of the above-mentioned patents particularly point out the unique features and advantages of the subject asphalt pulverizing apparatus.

SUMMARY OF THE INVENTION

The subject apparatus for pulverizing asphalt is simple in design, rugged in construction and is readily adaptable for mounting on various types of heavy duty mobile type equipment.

The asphalt pulverizing apparatus can be adapted for cutting various widths of ditches in an asphalt road bed from fifteen to thirty inches or greater. Also, the apparatus can cut from a depth of one to twenty-seven inches or greater and through asphalt roadways varying in depth from two to twenty-four inches.

The asphalt pulverizing apparatus is characterized by a drum with removable cutting tips which are rotated so that they engage the already pulverized asphalt mixed with a sand road base and then rotate into the sand base before engaging the softer underside of the unpulverized asphalt. The rotation of the drum with the tips pulverizes the asphalt and mixes it with the top of the sand base allowing the new mixture to be used for future road bases.

The invention eliminates the need of a ditch or road contractor from stripping the asphalt pavement from the roadway and hauling the removed pavement away be truck.

Further, the subject apparatus eliminates contractors from using drop hammers and the like which require high maintenance to keep in operation and cause excessive noise and potential window glass breakage when working in residential and commerical areas.

Also the apparatus is adaptable for receiving various widths of drums such as 12", 18", 24", 30", 36" 42" and greater and the drum can be quickly and easily removed and replaced with a different size drum. The drum can also be positioned anywhere along the width and in front of the mobile equipment. This feature is important when pulverizing asphalt adjacent a curb and gutter in a roadway. The cutting drum is surrounded by a float shield for dust and noise control when working in residential and commercial areas.

By mixing the top of the sand base with the broken asphalt the rotating cuttig tips are cooled prior to engaging the underside of the asphalt roadway thereby greatly increasing the wear life of the cutting tips and lower operating temperatures.

The apparatus for pulverizing asphalt on a roadway and similar applications includes a drum housing supported on the front of a mobile piece of equipment. The drum housing is raised and lowered by a hydraulic cylinder. A drive drum is mounted on the housing and rotated by a pair of hydraulic drive motors attached to drive plates which engage the opposite sides of the drum. The apparatus is adaptable for receiving various widths of drums having widths such as 12", 18" 24", 36", etc. Also the apparatus can position the drum along the width of the mobile equipment. The drum includes a plurality of removable tungsten carbide cutting tips disposed around the circumference of the drum. The drum is rotated in a direction opposite the forward travel of the mobile equipment so the tips engage the already pulverized asphalt and the top of the sand base for cooling the tips and allowing the tips to engage the softer underside of the asphalt roadway prior to pulverizing the asphalt as the mobile equipment moves forward.

The advantages and objects of the invention will become evident from the following detailed description of the drawings when read in connection with the accompanying drawings which illustrate preferred embodiments of the invention.

BRIEF DESCRIPTION OF THE DRAWINGS

FIG. 1A shows an enlarged view of a portion of the rotating drive drum with tips engaging the underside of the unpulverized asphalt road bed.

FIG. 2A illustrates a front cut-away view of the drive drum with hydraulic motor and hydrostatic gear drive.

DETAILED DESCRIPTION OF THE DRAWINGS

Figure 1:
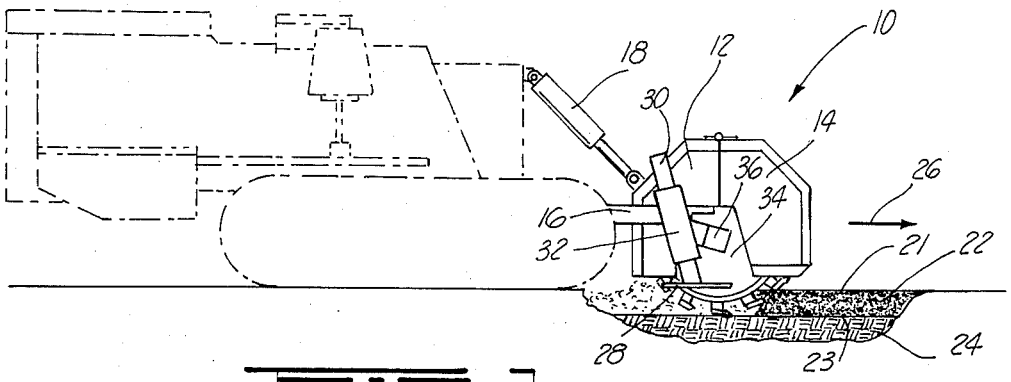
FIG. 1 illustrates a side view of the mobile equipment with the asphalt pulverizing apparatus mounted on the front thereof.

In FIG. 1 the apparatus for pulverizing asphalt on an asphalt roadway and similar applications is designated by general reference numeral 10. The apparatus 10 includes a housing 12 with hinged lid 14 mounted in the front thereof. The housing 12 is connected by housing support arms 16 and a hydraulic cylinder 18 to the front of a piece of mobile equipment 20 shown in dotted lines. The drum support arms which are shown more clearly in FIG. 2 are hinged to the front of the equipment 20 so the hydraulic cylinder 18 can raise and lower the apparatus 10 on top of an asphalt roadway 22 and a sand base 24.

Figure 4:
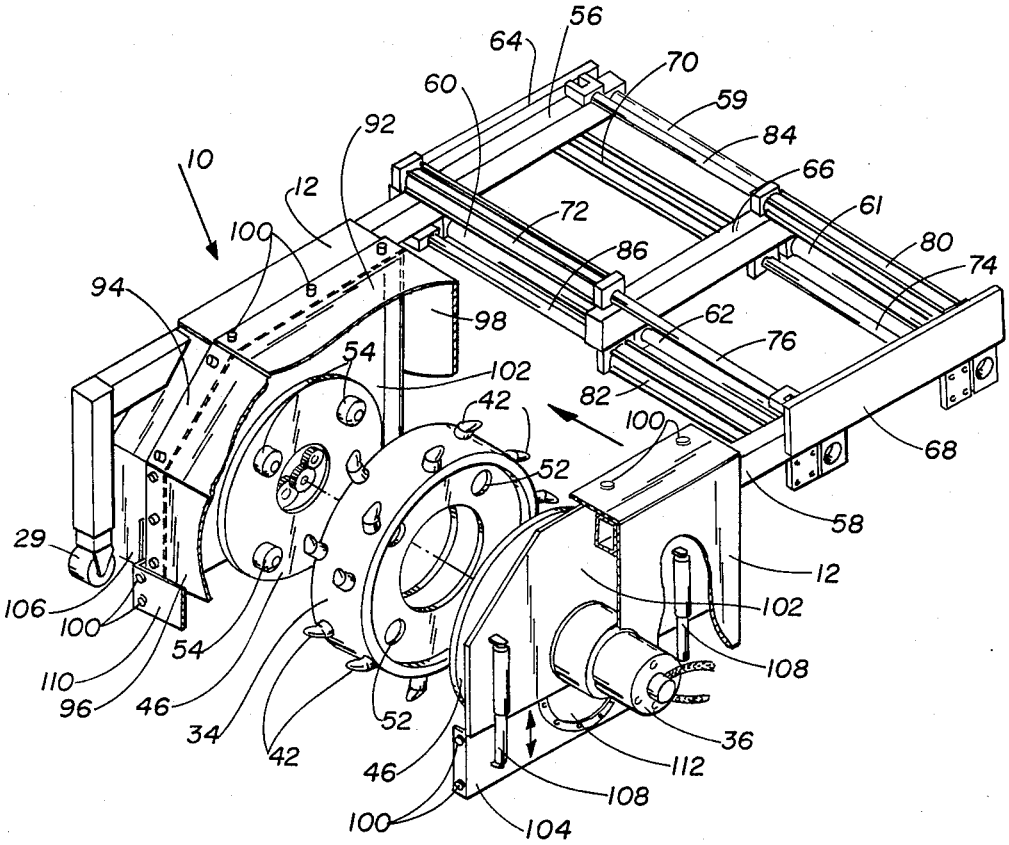
FIGS. 4 illustrates a perspective view of an improved pulverizing apparatus with movable slide arms for adjusting the drum along the width of the mobile quipment.

As the mobile piece of equipment 20 moves in a forward direction indicated by arrow 26, the housing 12 is supported on top of the roadway 22 by a pair of support shoes 28 connected to shoe arms 30 which are slidably received in sleeves 32. By adjusting the height of the shoes 28 on top of the roadway 22, the correct depth of cut can be properly adjusted and the shock loading on the hydraulic cylinder 18 is reduced as the apparatus 10 and equipment 20 is moved forward for cutting various widths of ditches in the roadway 22. While the shoes 28 are shown it can be appreciated that wheels or various other leveling devices could be used equally well such as rollers 29 attached to roller arms 31 as shown in FIG. 4 and positioned in front and on opposite sides of the housing 12.

Figure 2:
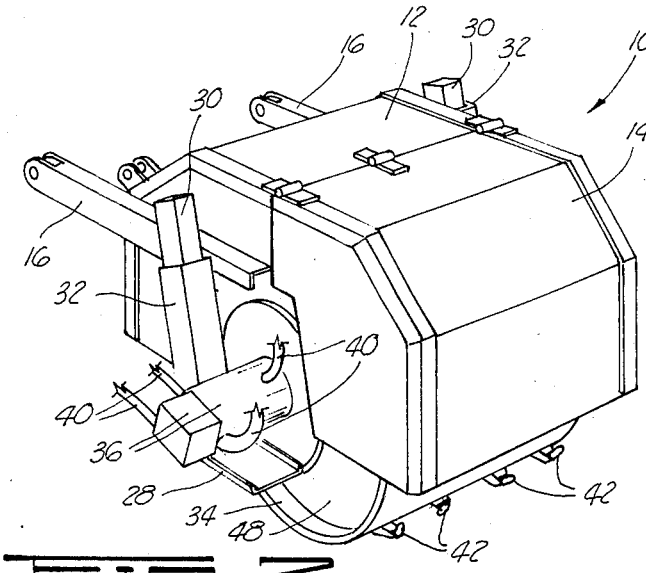
FIG. 2 is a perspective view of the asphalt pulverizing apparatus.
Figure 10:
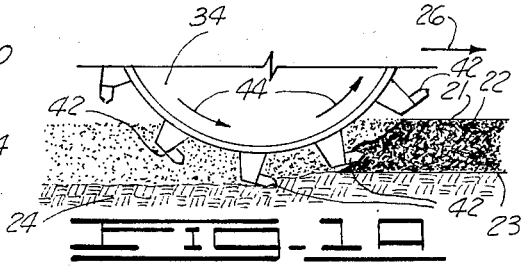

Mounted inside the housing 12 is a rotating drive drum 34 which is driven by a hydraulic motor 36 connected to a hydrostatic torque hub gear box 38 shown more clearly in FIG. 2A. The hydraulic motor 36 includes a plurality of hydraulic hoses 40 shown in FIG. 2 and connected to a hydraulic system mounted on the equipment 20. The hydraulic system is not shown in the drawings.

Referring now to FIG. 1A, an enlarged view of a portion of the drive drum 34 can be seen. Mounted around the circumference of the drum 34 are a plurality of removable tungsten cutting tips 42. It should be noted, rather than the tungsten tips 42 engaging a top portion 21 of the roadway 22 prior to pulverizing the roadway 22, the drum 34 is rotated by the hydraulic motor 36 in a direction as indicated by arrows 44 in a direction opposite to the forward travel indicated by arrow 26. When doing this, the tungsten tips 42 mounted on the drum 34 first engage the already pulverized asphalt mixed, for example, with the first two inches of the top of a sand base 24 with the mixture cooling the tungsten tips 42 prior to engaging a softer underside indicated by numeral 23 rather than the harder, more compact top portion 21 of the asphalt roadway 22. By engaging the already mixed asphalt with the sand base, the wear life of the tungsten tips 42 is greatly increased. Further, the operating temperature of the apparatus 10 is reduced and the efficiency and speed of cutting various widths and depths of ditches in the asphalt roadway 22 is greatly increased.

In FIG. 2 a perspective view of the apparatus 10 can be seen with the hinged lid 14 shown in a down and closed position on the drum housing 12. By raising the hinged lid 14, maintenance can be performed on the drive drum 34 such as removing the removable tungsten cutting tips 42 when required. Also seen in this view is the hydraulic motor 36 connected to a drive plate 46 which engages the side of a drum plate 48 shown in FIG. 3.

In FIG. 2A a front view of the drive drum 34 is shown with a portion of the drum 34 cut-away to expose the hydrostatic gear drive 38 mounted therein and connected to the hydraulic motor 36. On the opposite side of the drum 34 is a support plate 47 having a drum support bearing 49 mounted thereon. The drum support bearing 49 is connected to the drum housing 12 for supporting and allowing the drum 34 to rotate thereon.

Figure 3:
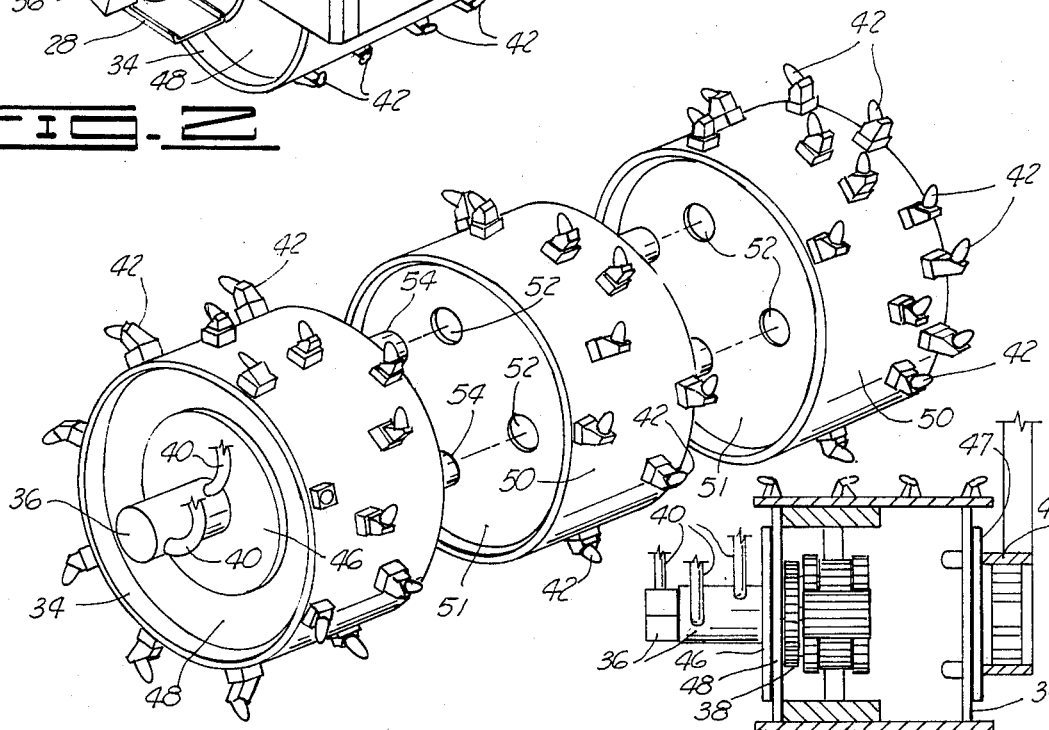
FIG. 3 illustrates a perspective view of the drive drum with a pair of idle drums positioned for engaging the drive drum and increasing the width of the apparatus for cutting different sizes of ditches.
Figure 20:
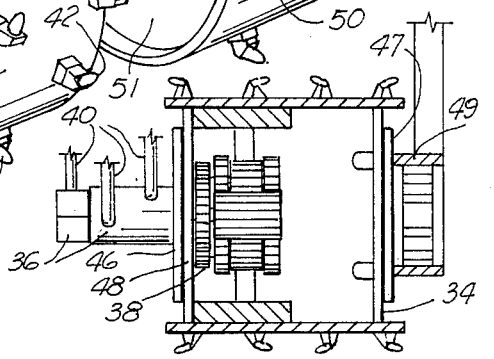

In FIG. 3 a pair of idle drums 50 are illustrated having a plurality of removable tungsten cutting tips 42 disposed therearound. The idle durms 50 include drum plates 51 mounted on opposite sides of the drums 50 and having a plurality of apertures 52 therein for receiving studs 54 extending outwardly from adjacent drum plates. When the studs 54 are indexed with the apertures 52 and received therein, the idle drums 50 can be coupled to the drive drum 34 for increasing the width of the apparatus 10 so the cutting width can be increased for example, from fifteen inches to thirty inches if one idle drum 50 is added or to forty-five inches by adding two idle arms 50. In this way the width of the ditch to be cut in the asphalt roadway 22 can be varied depending on the type of ditch construction to be performed.

Figure 5:
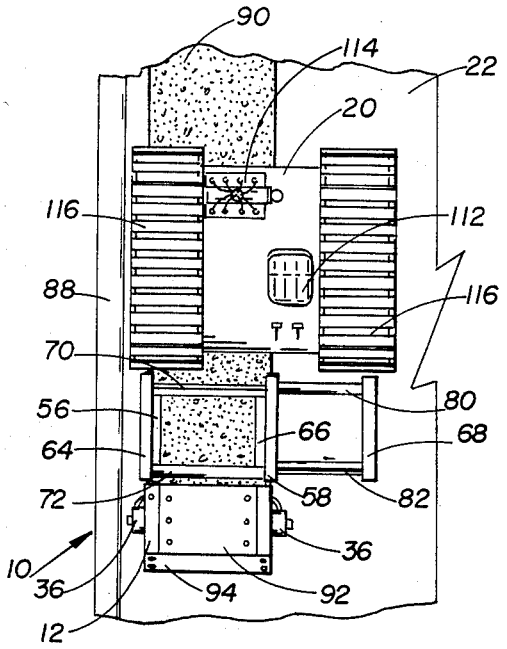
FIG. 5 illustrates a top view of the mobile equipment pulverizing a strip of asphalt adjacent a street curb and gutter.

In FIG. 4 a perspective view of an alternate embodiment of the apparatus 10 is shown. The housing 12 rather than being connected to support arms 16 is connected to first and second movable slide arms 56 and 58. The arm 56 is slidably mounted on cross slides 59 and 60. The arm 58 is slidably mounted on cross slides 61 and 62. The cross slides 59, 60, 61 and 62 are secured to a stationary frame made up of stationary arms 64, 66 and 68. Attached to the stationary arms 64 and 66 are a pair of hydraulic cylinders 70 and 72 with rams 74 and 76 attached to the movable slide arm 58. Attached to the stationary arms 66 and 68 are a pair of hydraulic cylinders 80 and 82 with rams 84 and 86 attached to the movable arm 56. The movable slide arms 56 and 58, by actuating the cylinders 70, 72, 80 and 82, allow the housing 12 attached to the slide arms to be centered in front of the equipment 20, moved toward the right or the center of the roadway 22 or moved to the left and adjacent a curb and gutter 88 as shown in FIG. 5 for cutting a strip 90 of pulverized asphalt. The apparatus 10 as shown in FIG. 4 is readily adaptable for receiving various widths of cutting drums 34 having widths such as 12", 18", 24", 30", 36", 42" and greater if necessary.

Referring to FIG. 4 again the housing 12 includes a removable metal top cover 92, front covers 94 and 96 and back cover 98. The covers are attached to the housing 12 using upwardly extending posts 100 on opposite sides of the housing. The covers come in different lengths to allow for the different widths of the cutting drum 34. Also attached to the housing 12 is a support plate 102 shown in FIG. 6. Mounted on the support plate 102 are floating shields 104 and 106. The shields 104 and 106 are allowed to float adjacent the top of the roadway 22 using gas shocks 108. The shocks 108 are attached at one end to the shields 104 and 106 with the other end of the shocks attached to the support plate 102. In FIG. 4 the shocks 108 attached to the floating shield 106 are hidden from view. Mounted in front of the oppositely disposed floating shields 104 and 106 is a removable front shield plate 110. The front shield plate 110 also comes in different lengths for adjustment for the different widths of the cutting drums. The shields 104 and 106 also include a rubber boot 112 which is adjacent the hydraulic motor 36. The floating shields 104 and 106, with attached front plate 110 allow for complete enclosure of the cutting drum 34 inside the housing 12 for control of dust and related noise.

Figure 6:
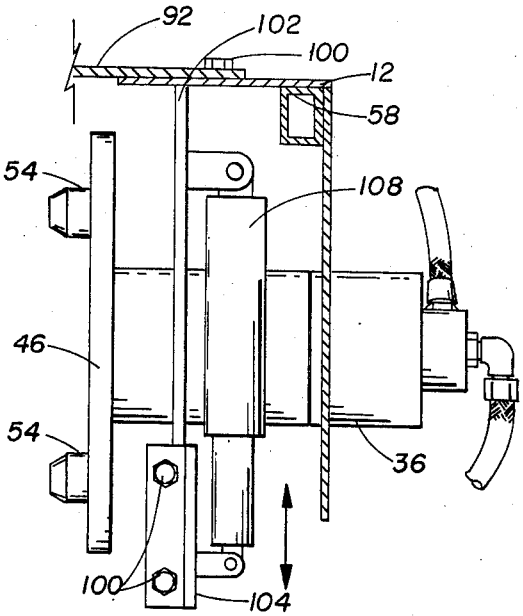
FIG. 6 is a side view of one of the drive motors and floating shield.

Referring now to both FIGS. 4 and 6 the different width cutting drums 34 are driven by hydraulic motors 36 mounted on opposite sides of the housing 12 and having drive plates 46 with outwardly extending studs 54 thereon for releasable engagement in apertures 52 which are equally spaced on opposite sides of the drum 34.

In FIG. 5 a top view of the equipment 20 can be seen having a seat 112, engine 114 and crawler tracks 116. Mounted in front of the equipment 20 is the asphalt pulverizing apparatus 10 which has been moved to the far left adjacent the curb and gutter 88. In this position and with a proper width of cutting drum 34, such as a 36" drum, the asphalt is pulverized leaving the strip 90 as shown. The drum 34 is completely enclosed in the housing 12 as shown using the removable covers flouting shield and front shield plate.

When it is desired to move the apparatus 10, the hydraulic cylinders are actuated with the housing 12 and drum 34 moved to the far right or centered in front of the equipment 20. By removing the covers and front shield plate, the hydraulic cylinders can also be used to move the movable slide arms 56 and 58 outwardly away from the sides of the cutting drum 34 allowing the release of the drive plates 46 from the sides of the drum and thereby allowing removal of the drum 34 so that a new drum having a greater or smaller width can be installed for cutting various widths of asphalt in the roadway 22.

Changes may be made in the construction and arrangement of the parts or elements of the embodiments as described herein without departing from the spirit or scope of the invention defined in the following claims.

What is claimed is:

1. An apparatus for pulverizing asphalt on an asphalt roadway and similar application, the apparatus mounted on a piece of mobile equipment for cutting through and pulverizing the asphalt roadway and cutting into the top of a sand base underneath the asphalt roadway, the apparatus comprising:

a drum housing supported on the front of the mobile equipment;

means for raising and lowering the housing on the equipment;

a drive drum mounted in the housing, the drum having a plurality of removable cutting tips disposed around the surface of the drum for engaging and pulverizing asphalt;

drum rotation means attached to the housing for rotating the drum thereon, the drum rotation means adapted for releasably engaging and disengaging a side of the drive drum; and means for moving the drive drum laterally in front of the mobile equipment and for engaging and disengaging the drum rotation means from the drive drum, the means for moving the drive drum connected to the mobile equipment and drum housing.

2. The apparatus as described in claim 1 wherein drum rotation means is a hydraulic motor connected to a drive plate, the plate adapted for releasable engagement to the side of the drum so that different widths of drums can be mounted in the housing.

3. The apparatus as described in claim 1 wherein the means for raising and lowering the drum housing is a hydraulic cylinder connected to the housing and the mobile equipment.

4. The apparatus as described in claim 1 wherein the means for moving the drive drum laterally and for engaging and disengaging the drum rotation means includes a stationary frame attached to the mobile equipment and extending outwardly therefrom, slide arms slidably mounted on the frame and connected to the housing and more than one hydraulic cylinder and ram connected to the frame and slide arms for moving the housing and drum laterally in front of the mobile equipment and for engaging and disengaging the drum rotation means with the drive drum.

5. The apparatus as described in claim 1 wherein the drum rotation means includes a pair of hydraulic motors disposed on opposite sides of the housing and having drive plates adapted for releasable engagement to opposite sides of the drum so that different widths of drums can be mounted in the housing.

6. The apparatus as described in claim 1 further including height adjustment means disposed on opposite sides of the drum housing and engaging the top of the asphalt roadway to aid in regulating the height when the rotating drive drum engages and pulverizes the asphalt roadway and the top of the roadway base.

7. The apparatus as described in claim 1 further including a floating shield attached to the front and sides of the housing and adjacent the roadway.

8. An aparatus for pulverizing asphalt on an asphalt roadway and similar applications, the apparatus mounted on a piece of mobile equipment for cutting through and pulverizing the asphalt roadway and cutting into the top of a sand base underneath the asphalt roadway, the apparatus comprising:

a drum housing supported on the front of the equipment;

a hydraulic cylinder connected to the mobile equipment and the drum housing for raising and lowering the drum housing in front of the equipment;

a drive drum rotatably mounted in the housing, the drum having a plurality of removable cutting tips disposed around the circumference of the drum, the tips used for engaging and pulverizing the asphalt roadway, the drive drum having sides with apertures indexed therearound;

a pair of oppositely disposed hydraulic motors mounted on the housing and connected to drive plates having outwardly extending studs for releasable engagement of the sides of the drive drum by inserting the studs inside the aperatures indexed around the sides of the drum; and a stationary frame attached to the mobile equipment and extending outwardly therefrom with slide arms slidably mounted on the frame and connected to the housing with more than one hydraulic cylinder and ram connected to the frame and the slide arms for moving the housing and the drum laterally in front of the equipment and for engaging and disengaging the drive plates from the sides of the drive drum.

* * * * *